US005841342A

United States Patent [19]

Hegmann et al.

[11] Patent Number: 5,841,342

[45] Date of Patent: Nov. 24, 1998

[54] VOLTAGE CONTROLLED SUPERCONDUCTING MICROWAVE SWITCH AND METHOD OF OPERATION THEREOF

[75] Inventors: Frank A. Hegmann, Santa Barbara, Calif.; Steven H. Moffat, Hamilton, Canada; John S. Preston, Dundas, Canada; Darcy G. Poulin, Ontario, Canada

[73] Assignee: Com Dev Ltd., Cambridge, Canada

[21] Appl. No.: 542,813

[22] Filed: Oct. 13, 1995

[51] Int. Cl.[6] ..... H01P 1/00

[52] U.S. Cl. ..... 338/325; 338/216; 338/217; 333/995

[58] Field of Search ..... 361/141; 338/13, 338/325, 216, 217; 333/995, 262; 363/14

[56] References Cited

U.S. PATENT DOCUMENTS

| | | | |
|---|---|---|---|
| 3,283,282 | 11/1966 | Lee et al. | 338/32 S |
| 3,761,846 | 9/1973 | Tsuboi | 333/33 |
| 3,916,432 | 10/1975 | Huebener et al. | 338/13 |
| 4,754,384 | 6/1988 | Levy et al. | 363/141 |
| 5,350,739 | 9/1994 | Martens et al. | 333/92 S |
| 5,496,796 | 3/1996 | Das | 333/99 S |
| 5,554,585 | 9/1996 | Simon et al. | 333/99 S |

*Primary Examiner*—Mark H. Paschall
*Assistant Examiner*—Karl Easthom
*Attorney, Agent, or Firm*—Daryl W. Schnurr

[57] ABSTRACT

A low insertion loss, wide bandwidth, microwave switch has a superconducting transmission line that can reversibly go from a superconducting state to a normal state by the application of a DC voltage. When in the normal state, the switch is "off" and microwave signals are attenuated. To reduce the voltage necessary to cause switching, the width of the transmission line is decreased. This decrease in voltage is accomplished in a controlled manner so that there are no spurious reflections produced on the line, resulting in a wide operating bandwidth. Previous microwave switches use other means to switch between superconducting and normal and suffer from disadvantages such as relatively slow switching time, complexity or narrow bandwidths as a result.

17 Claims, 3 Drawing Sheets

VOLTAGE CONTROLLED SUPERCONDUCTING MICROWAVE SWITCH AND METHOD OF OPERATION THEREOF

BACKGROUND OF THE INVENTION

1. Field of the Invention

This invention relates to a voltage controlled microwave switch that has a microwave transmission line that can be reversibly switched from a superconducting "on" state to a normal "off" state and to a method of operation of said switch.

2. Description of the Prior Art

It is known to have microwave switches that employ PIN diodes as the switching device. When forward biased, a PIN diode behaves like an "on" switch and when reverse biased, it behaves like an "off" switch. However, the PIN diode introduces a series resistance when mounted on a transmission line, and its maximum power handling capability is limited by the value of the avalanche voltage of the diode. Finally, PIN diodes can be difficult to integrate with superconducting circuits.

U.S. Pat. No. 4,963,852 issued on Oct. 16th, 1990 and naming Drehman as inventor describes a superconductor switch that is controlled by current. The switch described is not a microwave switch and does not have a transmission line. Since the switch is current controlled, current flows through the device when the switch is "on" and a substantially reduced current flows through the device when the switch is "off". The current controlled switch has a high level of power dissipation and a substantial risk of damage to the superconductor when the switch is in the "off" position (i.e. when the current is on). It is not feasible to use a current control in a microwave switch because of the very high power dissipation during switching, the relatively slow switching time and the size limitations of a microwave switch. Also, the Drehman switch cannot be used as an attenuator.

Superconductors have been used previously in microwave switches. In some versions, the temperature of the entire switching region is varied using an external means such as a heater or light source. Usually, these types of switches have slow switching speeds and increased complexity. Other switches have used applied magnetic fields to decrease the critical temperature of the superconductor below the temperature of the cryogen (see U.S. Pat. No. 4,876,239 naming Cachier as inventor). Still other switches use current pulses to switch the superconductor to the normal state and rely on resonant structures to provide adequate isolation. These switches usually have a relatively narrow bandwidth. Previous switches all suffer from one or more disadvantages in that they have slow switching speeds; they are extremely complex and/or expensive to manufacture; they have a relatively narrow operating bandwidth; they have a relatively high insertion loss; they have a high level of power consumption; they have relatively low power handling capability; they cannot be used as attenuators; or, they are not sufficiently durable.

SUMMARY OF THE INVENTION

It is an object of the present invention to provide a superconducting microwave switch that has a wide operating bandwidth and low overall insertion loss. It is a further object of the present invention to provide a superconducting switch that may be interconnected on integrating circuits with other superconducting circuits.

A voltage controlled superconducting microwave switch includes an insulating substrate having a superconducting film thereon, said film being shaped to form a microwave transmission line. The transmission line has a line input and a line output and is connected into a circuit. The circuit contains a constant DC voltage source connected into said circuit by connectors to minimize perturbation of the transmission line. The switch has a microwave signal input and a microwave signal output so that a microwave signal passes through said switch from said signal input to said signal output when said switch is "on" and virtually no signal passes through said switch when said switch is "off". The switch is "on" when the DC voltage is off and the switch switches to "off" when the DC voltage is turned on, said constant voltage causing said film to change from being superconductive to being normal, said film returning to being superconductive when said voltage is off.

A voltage controlled superconducting microwave switch includes an insulating substrate having a superconducting film thereon, said film being shaped to form a microwave transmission line. The transmission line has a line input and a line output and is connected into a circuit. The circuit contains a constant DC voltage source connected into said circuit by connectors to minimize perturbation of the transmission line. The switch has a microwave signal input and a microwave signal output so that a microwave signal passes through said switch from said signal input to said signal output when said switch is "on" and virtually no signal passes through said switch when said switch is "off". The switch is "on" when the DC voltage is turned low enough that virtually all of the signal passes through said switch and the switch switches to "off" when the DC voltage is turned high enough to cause said film to change from being superconductive to being normal, said film returning to being superconductive when said voltage is low enough that virtually all of the signal passes through said switch.

A method of operating a voltage controlled superconducting switch, said switch having an insulating substrate with a superconducting film thereon, said film being shaped to form a microwave transmission line. The transmission line is located in the circuit containing a constant DC voltage source. The source is connected into said circuit by bias-tees. The method comprises commencing with said switch in the "on" position, activating said constant voltage source to change said film from superconducting to normal, thereby causing said switch to be in the "off" position and subsequently deactivating said voltage source to return said film to superconducting, thereby moving said switch to the "on" position.

DESCRIPTION OF A PREFERRED EMBODIMENT

Figure 1:
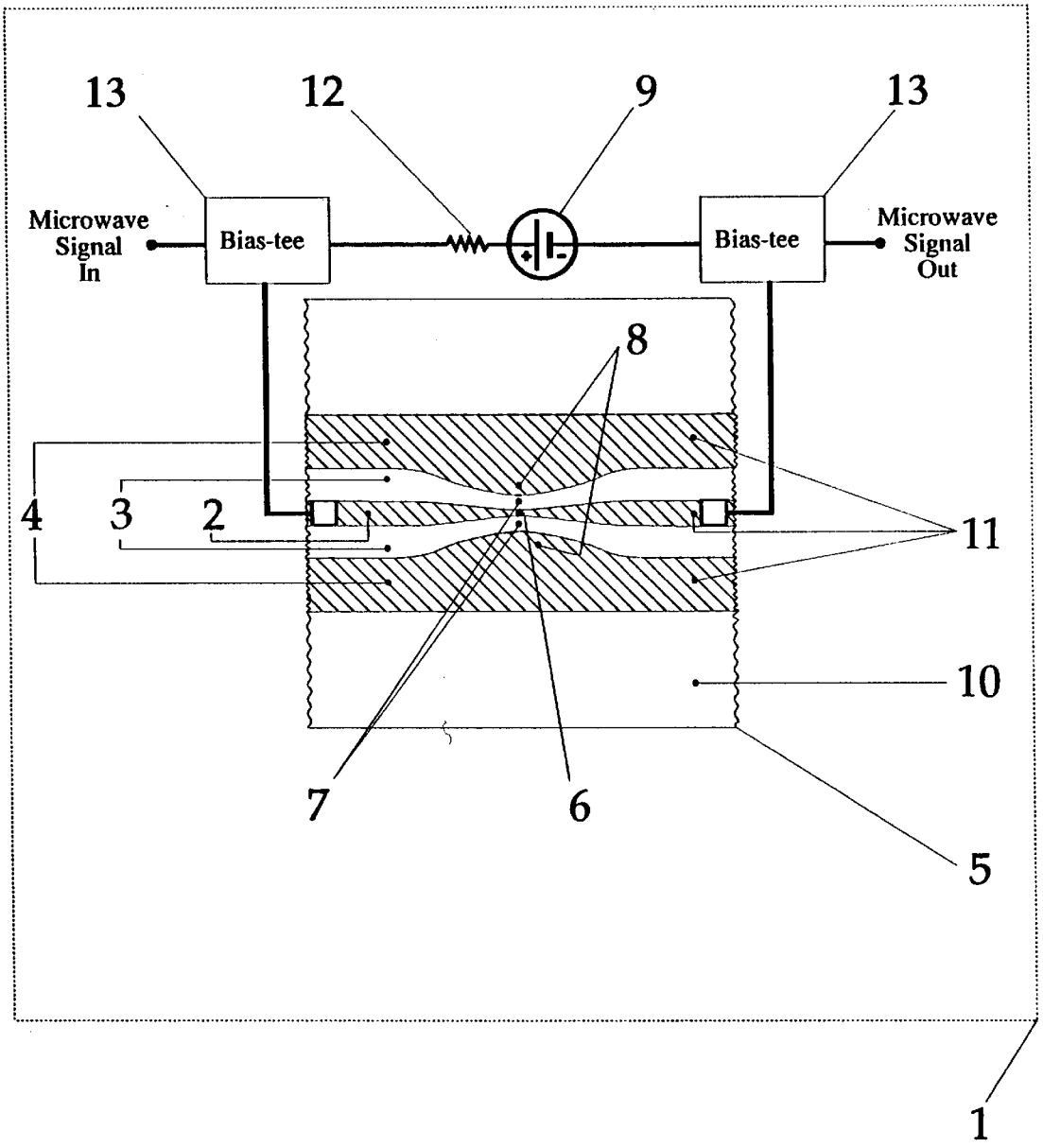
FIG. 1 is a top view of the microwave switch, with the DC control lines shown schematically.
Figure 2:
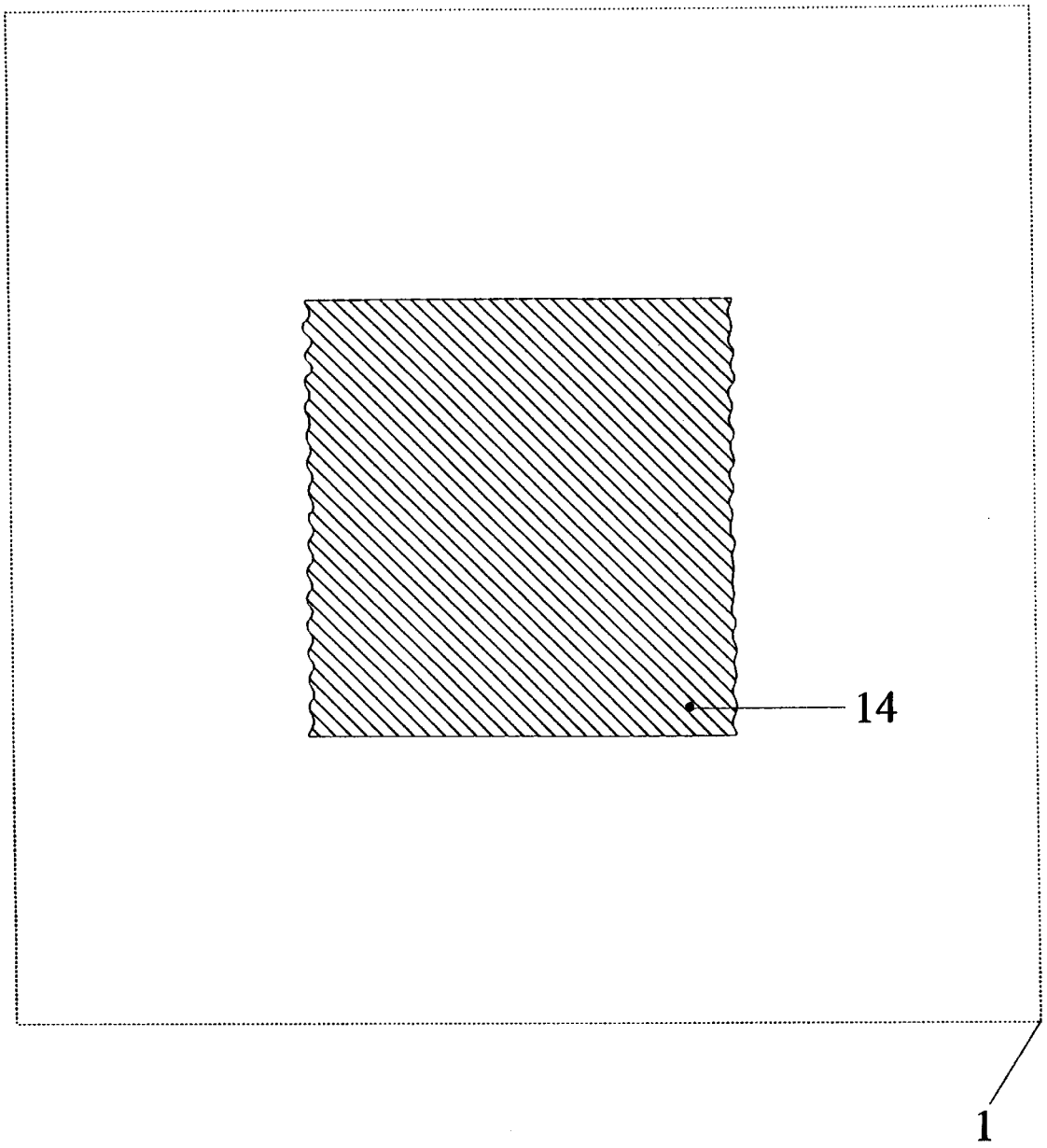
FIG. 2 is a bottom view of the microwave switch.

FIG. 1 shows a top view of a switch 1 according to the present invention. The switch 1 is a 50 Ohm coplanar waveguide transmission line 5 having a superconducting film 11 on an insulating substrate 10. The characteristic impedance of the transmission line 5 is controlled by the width of a center conductor 2, by the width of a gap 3 between the center conductor 2 and the adjacent ground planes 4 and by the thickness and dielectric constant of the substrate 10. Superconducting ground planes 4 are present adjacent to the gap 3, and may also be present on the back side of the insulating substrate 10 (shown as 14 in FIG. 2). The transmission line 5 is normally in the "on" state, until a DC voltage source 9 is enabled, causing a DC current to flow through the center conductor 2. To ensure that a relatively small voltage will be sufficient to cause switching of the transmission line 5, center conductor 2 is gradually tapered down to a much smaller width at reference numeral 6. To maintain a characteristic impedance of 50 Ohms throughout the transmission line 5, the gap 3 is reduced accordingly at reference numeral 7, and the ground plane width 4 is correspondingly increased at reference numeral 8. The exact width of the center conductor 2 at reference numeral 6 and of the gap 3 at reference numeral 7 yielding a characteristic impedance of 50 Ohms are determined for the substrate 10 of known thickness and dielectric constant in accordance with articles by Ghione and Naldi entitled "Parameters of Coplanar Waveguides with Lower Groundplane" appearing in Electronics Letters, Volume 19, 1983, at pages 734–735, and "Analytical Formulas for Coplanar Lines in Hybrid and Monolithic MICs" appearing in Electronic Letters, Volume 20, 1984, at pages 179–181. The center conductor 2 of the switch 1 must be a superconducting film, for example $Y_1Ba_2Cu_3O_7$. The ground planes 4, and the ground plane 14 that may be present on the back side of the insulating substrate 10, are preferably of the same material as the center conductor 2, but the device will function (usually with increased insertion losses) when any conductor is used. The biasing voltage source 9 is connected to the center conductor 2 through an optional bias resistor 12. The connection of the bias voltage source 9 and bias resistor 12 is shown only schematically in FIG. 1. The connection is made with minimal perturbation of the microwave transmission line 5 by using two bias-tees 13, one on either side of the voltage source.

Figure 3:
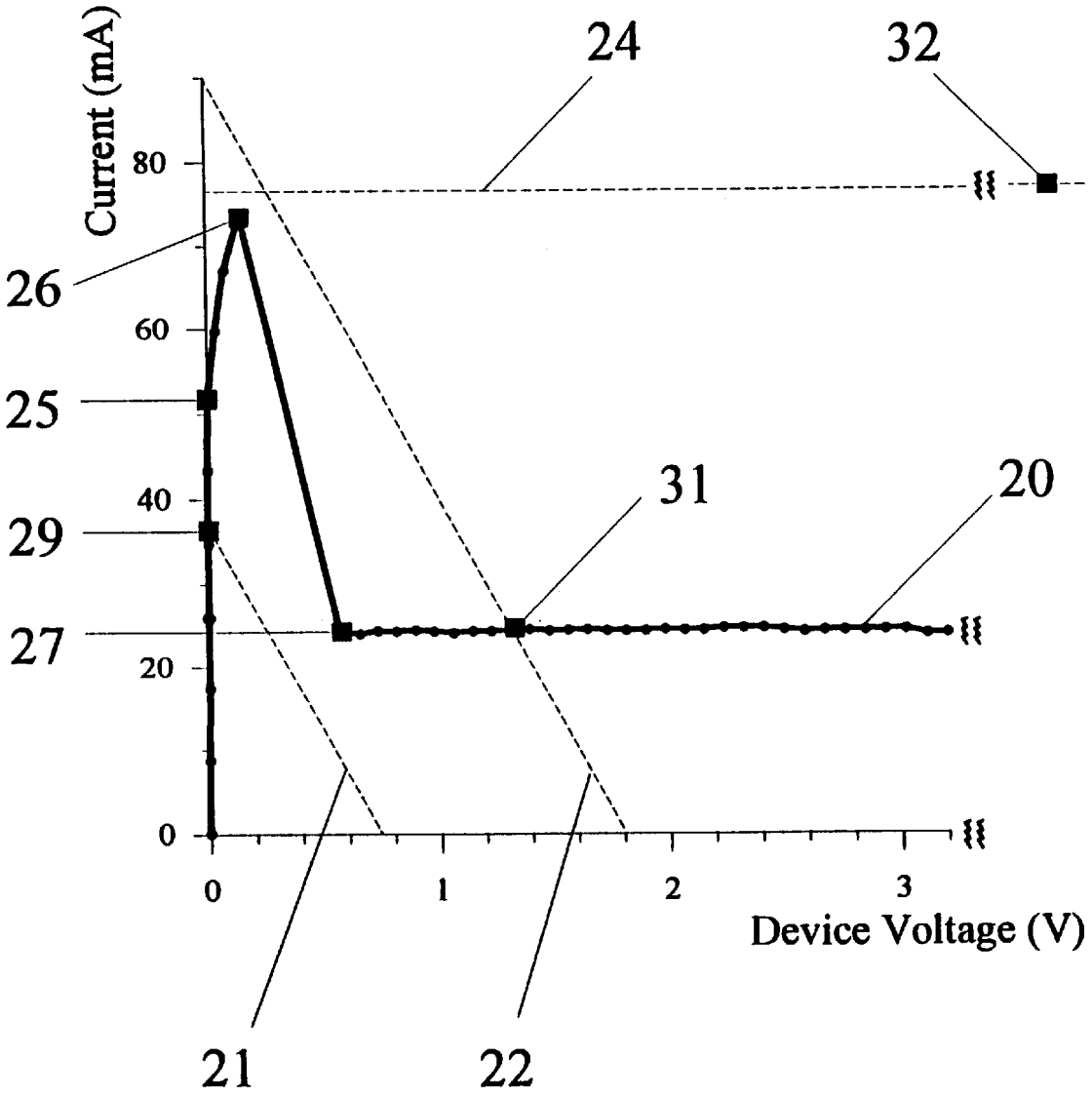
FIG. 3 is a typical current versus voltage (IV) curve for the structure shown in FIG. 1, with DC load lines shown as an aid in determining the operation point of the device.

FIG. 3 shows the switching characteristic of a typical device patterned as shown in FIG. 1. The IV curve 20 shows the current as a function of the device voltage. The term "device voltage" refers to the actual voltage appearing across the switch. The term "applied voltage" refers to the voltage set on the biasing voltage source 9. The current increases rapidly with very small device voltage, until a critical current 25 is reached, and a small resistance appears across the film for further increases in the device voltage. As the device voltage continues to increase, the resistance of the film further increases until a thermal switching current 26 is reached when the current abruptly decreases to a current 27 and the film resistance abruptly increases. Further increases in the device voltage result in little change in the current. This current remains approximately constant until a much larger voltage is utilized (not shown in FIG. 3) when the current again increases. As can be seen, the voltage is chosen so that the current is substantially constant and the current is at a level below the thermal switching current. Also shown in FIG. 3 are two load lines, 21 and 22, which determine the DC operating point with a 20 Ohm bias resistor for two different applied voltages 9. For a 0.75 Volt applied voltage, load line 21 applies, and the current level will be that shown at 29. For a 1.8 Volt applied voltage, load line 22 applies, the thermal switching current has been exceeded, and the device has switched to "off" at a current level shown at 31. Load line 24 is a load line that would apply if a constant current source was used to bias the device in place of the constant voltage source of the present invention. In this case, the device voltage in the switched state, if attainable without permanent damage occurring, would be that shown at 32, and much greater power (given by the product of the current and the voltage) would be dissipated in the device. It has been found that the switch of the present invention will not work when a constant current source and voltage limit are used in place of the constant voltage source because the heat and power generated cause the conductor 2 to break. Voltage biasing results in safer switch operation since power dissipation levels are controllable and are greatly reduced. Additionally, by reducing the value of the load resistance 12 towards zero, power dissipation in the switched state is minimized.

It is believed that the slightly increased resistance between current 25 and current 26 is due to flux creep. This effect is described by Anderson in "Theory of Flux Creep in Hard Superconductors", appearing in Physical Review Letters, Volume 9, 1962, pages 309–311. The onset of a large resistance when the current drops abruptly from 26 to 27 is believed to occur when the temperature of a short region in the tapered section 6 of the center conductor suddenly rises above the critical temperature of the superconductor. When this "hot spot" is present, the device is in the "off" state, and the current through the center conductor 2 is substantially reduced. Since the resistance associated with the "hot spot" is large, it continues to dissipate power, and is therefore a stable region. Microwave energy is also absorbed in this region, leading to decreased microwave transmission through the device when in the "off" state. When the applied DC voltage 9 is reduced to zero, the "hot spot" disappears, the switch turns "on", and the microwave signal is transmitted with minimal attenuation.

The switch can be used as an attenuator. The microwave attenuation can be continuously adjusted by changing the applied voltage. For zero applied voltage, the attenuation is approximately zero. For larger applied voltages, after the current reaches the thermal switching current 26, a "hot spot" develops, the current decreases, and microwave signals are attenuated. Microwave attenuation increases as the applied voltage is further increased, with the ultimate limit governed by the maximum allowable power dissipation of the superconducting film 11.

In the preferred embodiment of FIG. 1, the signal carrying center conductor 2 of the transmission line tapers down in width to reduce the required applied voltage 9 necessary to attain the thermal switching current 26. However, it will be readily apparent to those skilled in the art that this applied voltage can also be reduced by decreasing the thickness of the superconducting film 11, by increasing the temperature so the operating temperature is closer to the critical temperature, by selective irradiating a portion of the film with an ion beam, or by any combination of these techniques. Additionally, the technique disclosed herein is not limited to a coplanar waveguide configuration. Other superconducting planar transmission lines including microstrip and stripline can also be employed for switching, if the applied voltage necessary to induce switching is sufficiently small to be practical. For microstrip and stripline circuits, the signal carrying conductors for 50 Ohm systems are relatively wide, so impractically large applied voltages would be required. These types of transmission lines would require ion beam irradiation or operation at temperatures closer to the critical temperature for practical use.

The switch of the present invention can be used, for example, as part of a microwave phase shifter, as a redundancy switch in a satellite communication system, or as a microwave attenuator. The switch of the present invention has advantages over prior art switches in that it has a relatively wide bandwidth of operation; it has relatively low losses due to the presence of the switch in the transmission line in the "on" state and the isolation when the switch is in the "off" state; the switching time between the "on" state and the "off" state is extremely short; it has relatively low power consumption; and it has relatively high power handling capability and long term stability and durability. The switch of the present invention also has a relatively fast switching speed and is easily integrated with superconducting circuits. Further, the switch can be manufactured with a miniaturized size because the power requirements are low and there is little excess heat generated, greatly increasing the life of the switch.

What we claim as our invention is:

1. A voltage controlled superconducting microwave switch, said switch comprising an insulating substrate having a superconducting film thereon, said film having a thermal switching current, said superconducting film being shaped to form a microwave transmission line, said transmission line having a line input and a line output and being connected into a circuit, said circuit containing a constant DC voltage source connected into said transmission line by connecting means to minimize perturbation of the transmission line, said voltage source creating a current in said transmission line when said voltage source is on, said switch having a microwave signal input and a microwave signal output so that a microwave signal passes through said connecting means from said signal input to said signal output when said switch is "on" and virtually no signal passes through said switch when said switch is "off", said switch being "on" when the DC voltage is turned off and said switch switching to "off" when said DC voltage is turned on, said constant voltage causing said film to change from being superconducting to being normal, said film returning to being superconductive when said voltage is off, said constant voltage being at a level so that said current is below said thermal switching current.

2. A switch as claimed in claim 1 wherein at least one of said connecting means is a bias-tee.

3. A switch as claimed in claim 2 wherein there are two bias-tees, one bias-tee being located between said signal input and said DC voltage source and the other bias-tee being located between said DC voltage source and said signal output.

4. A switch as claimed in claim 3 wherein the transmission line has a coplanar waveguide configuration between the line input and the line output.

5. A switch as claimed in claim 4 wherein the coplanar waveguide configuration has a tapering center conductor and a decreasing gap between the center conductor and adjacent ground planes located on either side of the conductors, said center conductor reducing the voltage necessary to effect switching while decreasing spurious reflections to maintain a wide operating bandwidth.

6. A switch as claimed in claim 5 wherein said transmission line is selected from the group of a non-tapering coplanar waveguide, a microstrip or a stripline.

7. A switch as claimed in claim 6 wherein the center conductor is a superconductor and the ground plane is a metal.

8. A switch as claimed in claim 7 wherein the superconductor is $Y_1Ba_2Cu_3O_7$ and the insulating substrate is $LaA10_3$.

9. A switch as claimed in claim 2 wherein the center signal carrying conductor tapers from a width of substantially 150 $\mu$m to a width of substantially 10 $\mu$m, the gap between the center conductor and the adjacent ground planes tapers from substantially 525 $\mu$m to substantially 18 $\mu$m and a thickness of an $LaA10_3$ insulating substrate is substantially 508 $\mu$m.

10. A switch comprising an insulating substrate having a superconducting film thereon, said film having a thermal switching current, said superconducting film being shaped to form a microwave transmission line, said transmission line having a line input and a line output and being connected into a circuit, said transmission line containing a constant DC voltage source connected into said transmission line by connectors to minimize perturbation of the transmission line, said voltage source creating a current in said transmission line when said voltage source is on, said connecting means having a microwave signal input and a microwave signal output so that a microwave signal passes through said switch from said signal input to said signal output when said switch is "on" and virtually no signal passes through said switch when said switch is "off", said switch being "on" when the DC voltage is turned low enough that virtually all of said signal passes through said switch and said switch switching to "off" when said DC voltage is turned high enough to cause said film to change from being superconductive to being normal, said film returning to being superconductive when said voltage is turned low enough that virtually all of said signal passes through said switch, said high voltage being at a level so that said current is below said thermal switching current.

11. A switch as claimed in claim 10 wherein at least one of said connecting means is a bias-tee.

12. A switch as claimed in claim 11 wherein there are two bias-tees, one bias-tee being located between said signal input and said DC voltage source and the other bias-tee being located between said DC voltage source and said signal output.

13. A switch as claimed in claim 12 wherein said switch is "on" when said DC voltage is turned off.

14. A switch as claimed in any one of claims 10, 11 or 13 wherein said switch is an attenuator and the DC voltage can be continuously adjusted between a minimum position and a maximum position, said microwave attenuation varying continuously with said voltage.

15. A switch as claimed in any one of claims 10, 12 or 14 wherein said switch is an attenuator and the DC voltage being continuously adjustable between a minimum of zero and a maximum voltage, said microwave attenuation varying with said voltage, said attenuation being zero when said voltage is zero and increasing as said voltage is increased.

16. A method of operating a voltage controlled superconducting switch, said switch having an insulating substrate with a superconducting film thereon, said film having a thermal switching current, said film being shaped to form a microwave transmission line, said transmission line being located in a circuit containing a constant DC voltage source, said source being connected into said transmission line by bias-tees, and creating a current in said transmission line when said voltage is on, said method comprising activating said voltage source to a voltage to change said film from superconducting to normal, choosing said voltage so that said current is below said thermal switching current, thereby causing said switch to be in the "off" position and subsequently deactivating said voltage source to return said film to superconducting, thereby moving said switch to the "on" position.

17. A method as claimed in claim 16 comprising the steps of using the switch as an attenuator, varying said voltage between zero and a maximum level to vary microwave attenuation between zero and a maximum respectively.

* * * * *